US007363888B2

(12) United States Patent
Klimmek et al.

(10) Patent No.: US 7,363,888 B2
(45) Date of Patent: Apr. 29, 2008

(54) TWO-STROKE ENGINE

(75) Inventors: Axel Klimmek, Schwaikheim (DE); Silke Kaminski, Waiblingen (DE); Werner Geyer, Berglen (DE); Roland Schmidt, Korb (DE); Tommy Roitsch, Waiblingen (DE); Ralf Blechsmidt, Kernen (DE); Andreas Bähner, Weinstadt (DE); Olaf Schmidt, Korb (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/306,868

(22) Filed: Jan. 13, 2006

(65) Prior Publication Data

US 2006/0225677 A1 Oct. 12, 2006

(30) Foreign Application Priority Data

Jan. 15, 2005 (DE) ..... 10 2005 002 013

(51) Int. Cl.
*F02B 33/04* (2006.01)
*F02B 25/00* (2006.01)

(52) U.S. Cl. ..... 123/73 PP; 123/73 A; 123/73 R; 123/65 R

(58) Field of Classification Search ..... 123/73 PP, 123/73 A, 73 R, 65 R
See application file for complete search history.

(56) References Cited

U.S. PATENT DOCUMENTS 4,353,333 A * 10/1982 Iio ..... 123/73 R
5,699,761 A * 12/1997 Yamaguchi et al. ..... 123/73 A
6,497,204 B1 * 12/2002 Miyazaki et al. ..... 123/73 PP
6,880,503 B2 * 4/2005 Rosskamp ..... 123/73 PP
6,895,910 B2 * 5/2005 Geyer et al. ..... 123/73 PP
6,912,979 B2 * 7/2005 Fleig et al. ..... 123/73 PP
6,945,203 B2 * 9/2005 Amend et al. ..... 123/73 PP
6,953,011 B2 * 10/2005 Geyer et al. ..... 123/73 PP
7,021,253 B2 * 4/2006 Amend et al. ..... 123/73 PP
2003/0111027 A1 * 6/2003 Schmidt et al. ..... 123/73 PP
2003/0217709 A1 * 11/2003 Geyer et al. ..... 123/73 PP
2004/0182338 A1 * 9/2004 Amend et al. ..... 123/73 PP
2004/0182339 A1 * 9/2004 Geyer et al. ..... 123/73 PP
2005/0183679 A1 * 8/2005 Yasuda ..... 123/73 PP
2005/0205043 A1 * 9/2005 Schmidt et al. ..... 123/197.1

* cited by examiner

*Primary Examiner*—Stephen K. Cronin
*Assistant Examiner*—Ka Chun Leung
(74) *Attorney, Agent, or Firm*—Gudrue E. Huckett

(57) ABSTRACT

A two-stroke engine has a cylinder and a piston reciprocating in the cylinder and delimiting a combustion chamber. The piston has at least one piston recess. A crankshaft is rotatably arranged in a crankcase connected to the cylinder. A connecting rod connects piston and crankshaft. Transfer channels connect the crankcase to the combustion chamber in pre-defined piston positions. The transfer channels each have a transfer port opening into the combustion chamber. A device for supplying fuel and an air channel supplying combustion air are provided. In predetermined piston positions, the air channel is connected by the piston recess to the transfer ports. The air channel opens into the cylinder bore opposite the exhaust for the exhaust gases. The air channel, the piston recess, and the transfer channels define an air passage that provides approximately uniform distribution of air from the air channel into the transfer channels.

14 Claims, 5 Drawing Sheets

TWO-STROKE ENGINE

BACKGROUND OF THE INVENTION

The invention relates to a two-stroke engine comprising a cylinder in which a combustion chamber is provided that is delimited by a reciprocating piston. The piston drives by means of a connecting rod the crankshaft rotatably supported in a crankcase. In pre-defined piston positions, the crankcase is connected to the combustion chamber by means of at least two transfer channels wherein each transfer channel opens with a transfer port into the combustion chamber. The engine comprises a device for supplying fuel and an air channel for supplying combustion air. In predetermined piston positions, the air channel is connected by a piston recess provided at the piston to the transfer ports of the two transfer channels. An exhaust for the exhaust gases generated in the combustion chamber is provided wherein the air channel opens into the cylinder bore on a side opposite the exhaust. The air channel, the piston recess, and the transfer channels define an air passage.

US 2003/0217712 A1 discloses a two-stroke engine in which combustion air is stored within the transfer channels; the transfer channels separate the exhaust gases within the combustion chamber from the fresh mixture that flows in from the crankcase. The air is supplied through an air channel that opens into the cylinder bore. In the area of the top dead center of the piston, the air channel is connected by means of a piston recess provided within the piston to two neighboring transfer channels. The air can flow through the piston recess into the transfer channels. The air channel and the mixture channel supplying the mixture to the two-stroke engine are arranged on a side of the cylinder opposite the exhaust of the combustion chamber. The air channel opens approximately horizontally into the cylinder bore. When air is flowing into the transfer channel proximal to the exhaust, the flow direction of the incoming air is deflected less than when flowing into the transfer channel that is remote from the exhaust and adjacent to the air channel. This causes a predominant portion of the scavenging air to be supplied to the exhaust-near transfer channels (transfer channels proximal to the exhaust) so that the scavenging air can pass through the exhaust-near transfer channel into the crankcase. At the same time, a complete filling with air of the transfer channels remote from (distal to) the exhaust is not achieved. This can lead to a deterioration of the exhaust gas values.

SUMMARY OF THE INVENTION

It is an object of the present invention to provide a two-stroke engine of the aforementioned kind that is of a simple configuration and has minimal exhaust gas values.

In accordance with the present invention, this is achieved in that the air passage is designed such that an approximately uniform distribution of the air into the transfer channels results.

Because of the uniform distribution of the air into the transfer channels, excellent scavenging of the combustion chamber and excellent separation of the exhaust gases from the fresh mixture being supplied from the crankcase can be achieved. By means of the constructive configuration of the air passage it can be ensured that in any operating state an excellent uniform filling of the transfer channels can be achieved.

Advantageously, the air flows into the piston recess in such a way that a distribution of the incoming air into the transfer channels in a ratio between 60% to 40% and 40% to 60% results. For such a distribution, excellent scavenging of the transfer channels and thus excellent separation of the exhaust gases exiting the combustion chamber from the incoming mixture can be achieved so that minimal exhaust gas values result. It is provided that the air channel opens into the cylinder bore such that the air flowing out of the air channel into the piston recess flows essentially against the ceiling of the piston recess.

By flowing against the ceiling of the piston recess, it can be achieved that the component of the flow direction that is directed toward the transfer channel near the exhaust is reduced. In this way, the exhaust-remote transfer channel is supplied with more air and the exhaust-near transfer channel is supplied with less air in comparison to a horizontal flow. This leads to a uniform distribution of the air into the exhaust-near and the exhaust-remote transfer channels.

It is provided that the air that leaves the air channel flows into the piston recess at an angle of less than 90 degrees, in particular, at an angle between 30 degrees and 60 degrees, relative to the upright or longitudinal direction of the cylinder. It was found that a uniform distribution of the air into the transfer channels can be achieved for such a flow angle.

Advantageously, means for distributing the air are provided in the cylinder. As a result of the relative movement of cylinder and piston, means for distributing the air provided at the piston recess are effective only in predetermined piston positions or they must extend across the entire height of the piston recess. In contrast to this, means for distributing the air provided in the cylinder, i.e., in the air channel and the transfer channels, are effective in any piston position. It is provided that means for distributing the air into the transfer channels are arranged in the air channel upstream of the air channel port. By arranging means for distributing the air in the air channel, the flow direction of the air flowing into the piston recess can be affected. In this way, the flow conditions in the piston recess and thus the distribution of the air into the transfer channels are affected.

However, it can also be advantageous that at least one transfer channel has means for affecting the distribution of air into the transfer channels. The means for distributing the air are particularly arranged in the exhaust-near transfer channel and configured as a throttle. The throttle in the exhaust-near transfer channel, in particular in the area of the exhaust-near transfer port, causes an increase of the flow resistance in the exhaust-near transfer channel and thus a reduction of the amount of air supplied to the exhaust-near transfer channel. Advantageously, the piston recess has means for distributing the air into the transfer channels. In particular, the air channel opens into the cylinder bore on a side of the cylinder opposite the exhaust. In order to reduce the amount of air that is supplied to the exhaust-near transfer channel, it is provided that in at least one piston position the exhaust-near transfer port is at least partially closed while the exhaust-remote transfer port is completely open relative to the piston recess. By reducing the free flow cross-section in the exhaust-remote transfer channels, the resulting distribution of air into the transfer channels can be affected additionally in a simple way. Expediently, one piston position in which the exhaust-near transfer port is at least partially closed while the exhaust-remote transfer port is open completely toward the piston recess is the top dead center of the piston.

A partial closure of the exhaust-near transfer channels can be achieved in a simple way in that the piston skirt closes off a section of the exhaust-near transfer port that extends in the circumferential direction of the piston. This can be achieved by an appropriate adaptation of the shape of the piston recess. For this purpose, it is provided that at least one section of the exhaust-near vertical or upright edge of the piston recess is displaced relative to the transfer port of the exhaust-near transfer channel into the interior of the piston recess. By means of this displacement of the edge of the piston recess, the transfer port is partially or completely closed so that a reduction of the supplied amount of air results and the air that continues to flow in from the air channel is completely directed into the exhaust-remote transfer channel. However, it can also be expedient that the piston skirt closes off a section of the exhaust-near transfer port that is positioned in the upright or longitudinal direction of the cylinder. When closing a section of the transfer port positioned in the upright direction, an approximately plane air front can be achieved in the transfer channel despite the partially closed transfer port. This ensures that the transfer channel can be completely scavenged so that the mixture coming from the crankcase is separated completely by combustion air from the exhaust gases in the combustion chamber.

Closure of the transfer port can be achieved in a simple way also in that the bottom edge of the piston recess in the area of the exhaust-near transfer port is displaced relative to the bottom edge in the area of the exhaust-remote transfer port in the direction toward the topside of the piston. Expediently, the stay or web that is formed between the piston recess and the bottom side of the piston is wider in the area of the exhaust-near transfer port than in the area of the exhaust-remote transfer port. In this way, it can be ensured that the exhaust-near transfer port is closed partially or even entirely by the piston skirt. Opening of the transfer port toward the crankcase is prevented by the widened stay.

For shortening the duration in which the exhaust-remote transfer port is connected by means of the piston recess to the air channel, it can be provided that the ceiling of the piston recess in the area of the exhaust-near transfer port is displaced relative to the ceiling in the area of the exhaust-remote transfer port in the direction toward the crankcase. This results in a delayed opening and earlier closing of the exhaust-near transfer port.

In the case of an internal combustion engine in which the air channel opens into the cylinder bore at a side of the cylinder opposite the exhaust, more air is supplied to the exhaust-remote transfer channel than to the exhaust-near transfer channel because of the flow direction. In this arrangement, the amount of air supplied to the exhaust-remote transfer channel must be reduced by means of the aforementioned measures, wherein the aforementioned measures for the exhaust-near transfer channel must be employed for the exhaust-remote transfer channel and vice versa.

Expediently, the connecting rod is secured by a piston pin on the piston; the piston pin is arranged approximately at the level of the ceiling of the piston port and projects at a piston pin boss to the exterior of the piston. Because the piston recess extends into the area of the piston pin, a comparatively long connection between air channel and the transfer channels can be ensured so that a sufficient amount of air can flow into the transfer channels. Advantageously, the piston pin boss is arranged in the piston recess. In this way, the piston recess can be designed to be large so that a large quantity of air can be supplied to the transfer channels. However, it can also be expedient to separate the piston pin boss by a stay or web from the piston recess. In this case, the surface area of the piston recess is reduced by the piston pin boss. Advantageously, the stay closes at least partially the exhaust-near transfer port in at least one piston position. In this way, the area of the piston pin boss can be used also to reduce the amount of air that is supplied to the exhaust-near transfer channel.

Expediently, the piston recess has a ramp for deflecting the flow in the piston recess into the exhaust-remote transfer port. A ramp can be arranged simply in the piston recess. By means of the design of the ramp, the distribution of air into the transfer channels can be affected in a simple way. The ramp can be arranged in the rear wall of the piston recess or can extend from the ceiling or from the bottom edge of the piston recess into the piston recess.

A mixture channel for supply of a fuel/air mixture to the cylinder communicates with the crankcase. Advantageously, at least a section of the length of the air channel extends on the side of the mixture channel that is facing the crankcase. In this way, a flow direction against the ceiling of the piston recess can be achieved in a simple way. It is provided that the air channel opens with an air channel port into the cylinder bore and that the air channel port is arranged on the side of the exhaust-remote transfer port that is facing the crankcase.

DESCRIPTION OF THE PREFERRED EMBODIMENTS

Figure 1:
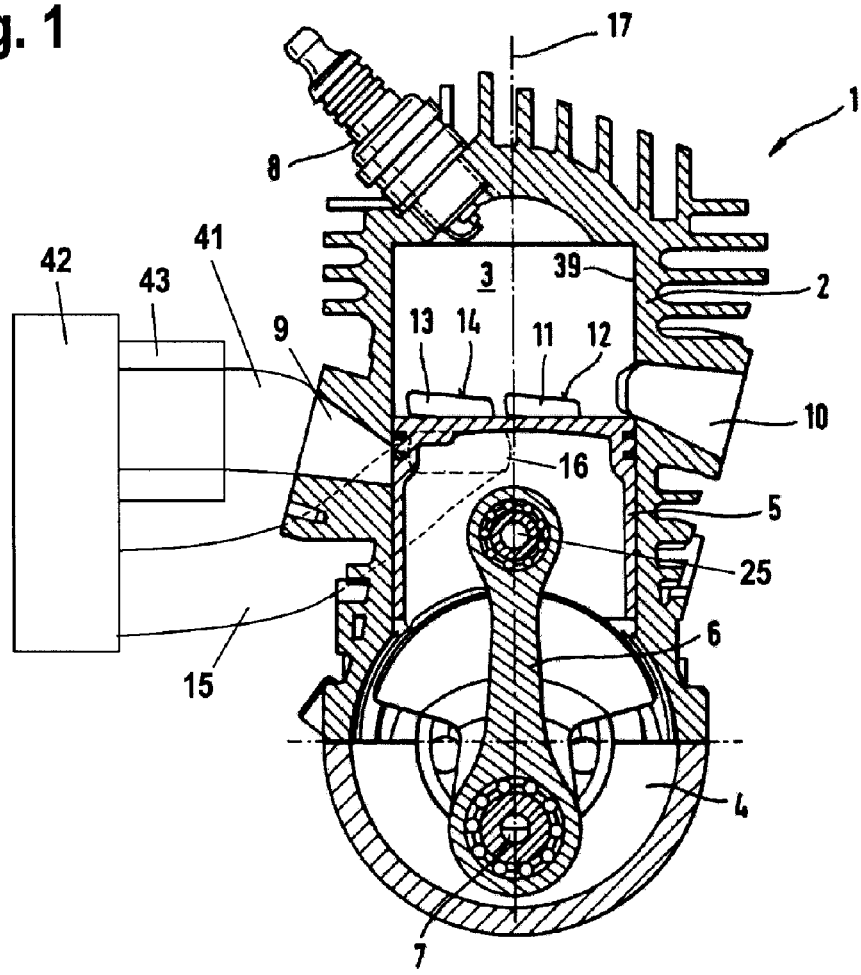
FIG. 1 is a schematic illustration of a longitudinal section of a two-stroke engine.

The two-stroke engine 1 illustrated in FIG. 1 comprises a cylinder 2 in which a combustion chamber 3 is formed. A spark plug 8 projects into the combustion chamber 3. The combustion chamber 3 is delimited by a piston 5 that reciprocates within the cylinder 2. The piston 5 drives by means of a connecting rod 6 the crankshaft 7 that is rotatably supported in a crankcase 4. The piston 5 is connected to the connecting rod 6 by means of a piston pin 25. The piston 5 moves within the cylinder 2 in the direction of the longitudinal axis 17 of the cylinder. The two-stroke engine 1 has an intake 9 through which a fuel/air mixture is supplied to the crankcase 4. The intake 9 is connected by a mixture channel 41 to an air filter 42 through which ambient air is sucked in. A section of the mixture channel 41 is formed within carburetor 43 in which fuel is supplied to the combustion air. An exhaust 10 extends away from the combustion chamber 3; exhaust gases can escape from the combustion chamber 3 through the exhaust 10.

The two-stroke engine 1 has two exhaust-near transfer channels 11 and two exhaust-remote transfer channels 13 (see also FIG. 2) that open by means of transfer ports 12 and 14 into the combustion chamber 3 and connect the combustion chamber 3 to the crankcase 4 when the piston 5 is in the area of the bottom dead center (illustrated in FIG. 1). One of the exhaust-near transfer channels 11 and one of the exhaust-remote transfer channels 13 are positioned adjacent to one another on either side of the center plane 46 dividing the exhaust 10 and the intake 9 (see FIG. 2). Below the exhaust-remote transfer port 14, the air channel port 16 of the air channel 15 opens into the cylinder bore 39. The air channel 15 is connected to the air filter 42. External to the cylinder 2, the air channel 15 extends on the side of the mixture channel 41 that is facing the crankcase 4. In the area of the cylinder 2, the air channel 15 has two branches. Advantageously, the air channel 15 divides between the air filter 42 and the cylinder 2 into the two branches or divides within the cylinder wall of the cylinder 2 into the two branches.

Figure 2:
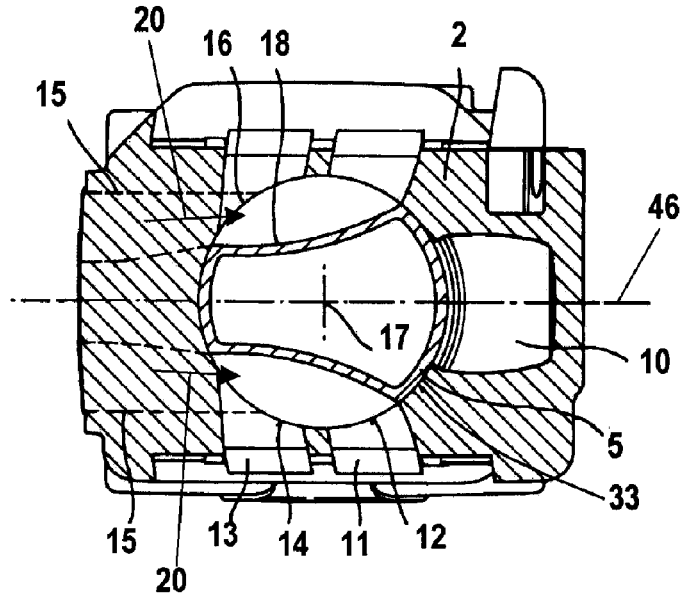
FIG. 2 is a schematic section view of a two-stroke engine at the level of the transfer ports showing the piston in the area of the top dead center.

As illustrated in FIG. 2, the piston 5 has two symmetrically arranged piston recesses 18 that are formed as depressions in the piston skirt 33. By means of the two piston recesses 18 the transfer ports 12 and 14 are connected to the air channel port 16. In the area of the bottom dead center (illustrated in FIG. 2) of the piston 5, the air flows in the air channel 15 in the flow direction 20 into the piston recess 18 and from there into the transfer channels 11 and 13. Each piston recess 18 connects one exhaust-near transfer channel 11 and one exhaust-remote transfer channel 13 to one branch of the air channel 15.

In operation of the two-stroke engine 1, a fuel/air mixture is sucked into the crankcase 4 through the intake 9 when the piston 5 is in the area of the top dead center. In this position of the piston 5, the transfer channels 11 and 13 are connected by the piston recesses 18 to the air channel 15 so that essentially fuel-free air can flow from the air channel 15 into the transfer channels 11, 13. In this way, the fuel/air mixture located in the transfer channels 11 and 13 is flushed into the crankcase 4. Upon downward stroke of the piston 5, the mixture is compressed within the crankcase 4. As soon as the transfer ports 12 and 14 open toward the combustion chamber 3, initially the air that is stored within the transfer channels 11 and 13 flows into the combustion chamber 3. The stored air scavenges the exhaust gases from the previous combustion cycle out of the combustion chamber 3 through the exhaust 10. Fuel/air mixture from the crankcase 4 flows in subsequently. Upon upward stroke of the piston 5 the mixture is compressed in the combustion chamber 3 and is ignited in the area of the top dead center by the spark plug 8. Because of the combustion, the piston 5 is accelerated in the direction toward the crankcase 4. As soon as the exhaust 10 opens, the exhaust gases flow out of the combustion chamber 3 and are scavenged by the air flowing in from the transfer channels.

In order to achieve an excellent scavenging result, the transfer channels 11 and 13 should be largely or completely filled with substantially fuel-free air from the air channel 15. As shown in FIG. 2, the air flows out of the air channel 15, viewed in section of the cylinder 2, in the direction toward the transfer ports 12 of the exhaust-near transfer channels 11. In the case of an approximately horizontal flow direction of the air into the piston recess 18, this leads to a large portion of the scavenging air flowing into the exhaust-near transfer channels 11. In this way, a complete flushing of the exhaust-remote transfer channels 13 cannot be ensured. In order to achieve that the exhaust-remote transfer channels 13 are also supplied satisfactorily with substantially fuel-free air, it is provided that the air from the air channel flows against the ceiling 19 of the piston recess 18.

Figure 3:
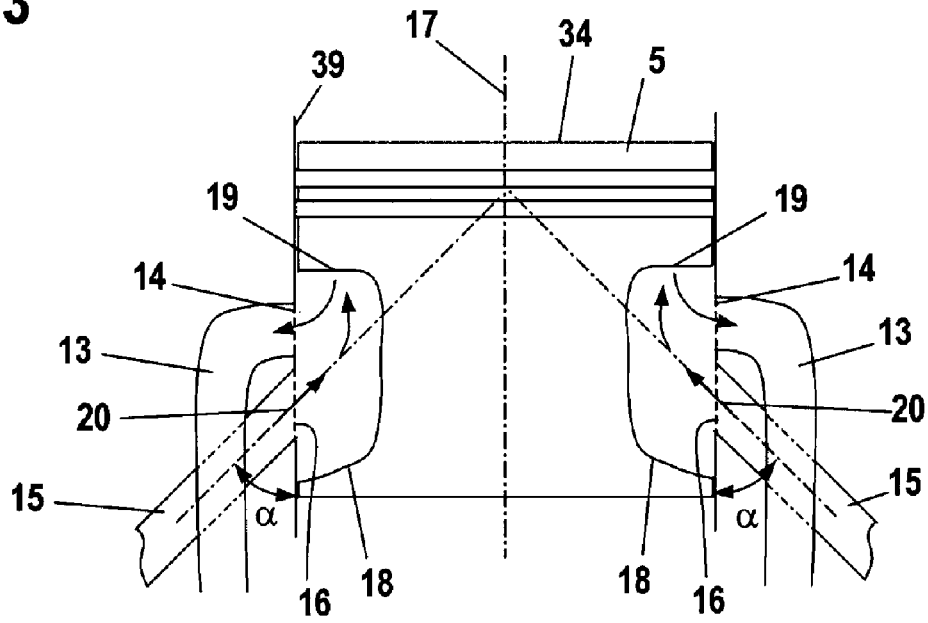
FIG. 3 is a schematic illustration of a piston with channels opening into the piston recesses.

In FIG. 3, the flow directions are schematically illustrated. In this connection, the two branches of the air channel 15 are rotated into the plane of the exhaust-remote transfer channels 13 for improved illustration. As shown in FIG. 3, the air flows out of the air channel 15 in the flow direction 20 into the piston recess 18 that is positioned relative to the cylinder bore 39 at an angle $\alpha$ that is smaller than 90 degrees. The angle $\alpha$ is advantageously within a range of 30 degrees to 60 degrees. Accordingly, the air that flows into the piston recess 18 is directed essentially against the ceiling 19 of the piston recess 18 that is facing the topside 34 of the piston 5. The air flow rebounds at the ceiling 19 and is deflected into the transfer ports 14 of the exhaust-remote transfer channels 13 and into the transfer ports 12 of the exhaust-near transfer channels 11 (not illustrated in FIG. 3). Because the air channel 15 opens into the cylinder bore 39 at an angle $\alpha$ of less than 90 degrees, it is achieved that the portion of the flow direction 20 oriented in the direction toward the exhaust-near transfer channel 11 is reduced. In this way, a uniform distribution of the scavenging air into both transfer channels 11 and 13 can be achieved. The angle $\alpha$ at which the air channel 15 opens into the cylinder bore 39 is advantageously selected such that the air is distributed in a ratio of 40% to 60% and 60% to 40% to the exhaust-remote transfer channel 13 and the exhaust-near transfer channel 11, respectively. This uniform distribution ensures excellent scavenging of the combustion chamber 3.

Figure 4:
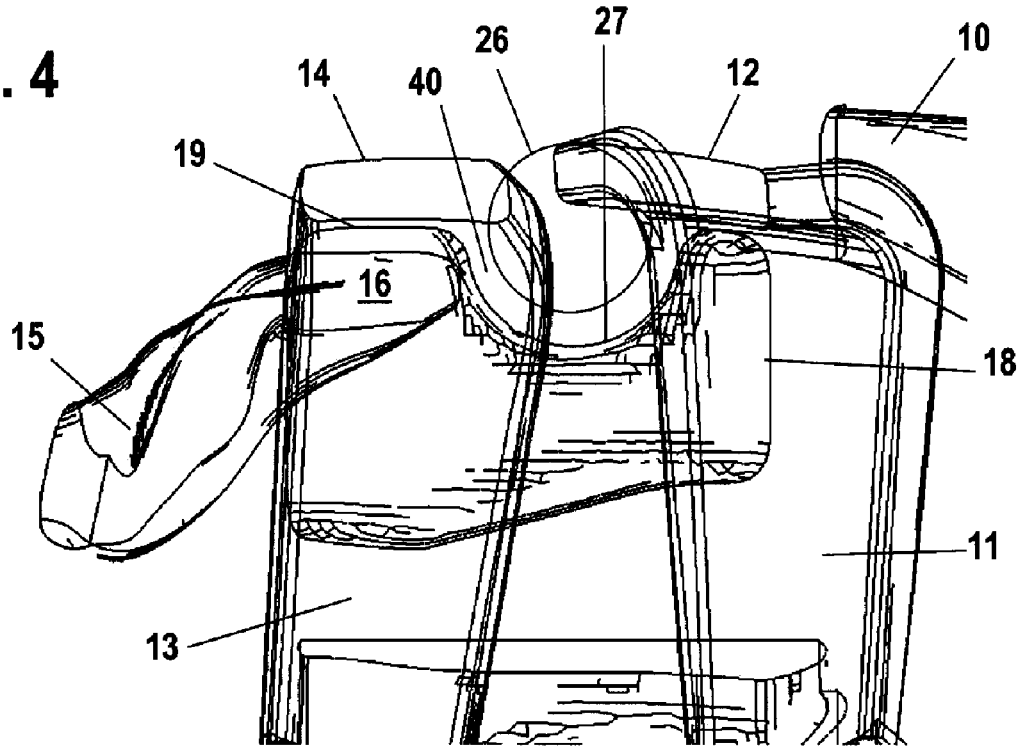
FIG. 4 is a schematic perspective illustration of an air channel, piston recess, and transfer channels.

FIG. 4 shows the transfer channels 11 and 13, the piston recess 18, and the air channel 15 in a perspective view. In this illustration, only the walls that delimit the channels are illustrated. The piston recess 18 is shown in a position of the piston in which the transfer channels are still closed by the piston skirt and no connection to the air channel 15 is present. As illustrated in FIG. 4, the piston pin boss 26 where the piston pin 25 projects to the exterior of the piston 5, is arranged at the level of the ceiling 19 of the piston recess 18. Between the piston pin boss 26 and the piston recess 18 a stay 40 is arranged that separates the piston pin boss 26 from the piston recess 18. As illustrated in FIG. 4, the piston pin boss 26 is arranged in the area of the transfer port 12 of the exhaust-near transfer channel 11. In the area of the piston pin boss 26 the piston recess 18 has a recessed portion 27. Upon further upward movement of the piston 5, first a small section, i.e., that half of the transfer port 12 facing away from the exhaust-remote transfer channel 13, is released by the piston recess 18. The other half of the transfer port 12 is covered by the piston pin boss 26 and the stay 40. The transfer port 14 of the exhaust-remote transfer channel 13 is only minimally covered by the piston pin boss 26 and the stay 40. In this way, the amount of air that is supplied to the exhaust-remote transfer channel 13 is increased and the amount of air supplied to the exhaust-near transfer channel 11 is reduced. As illustrated in FIG. 4, the air channel 15 opens into the piston recess 18 at an angle of less than 90 degrees so that the air entering the piston recess 18 flows substantially against the ceiling 19 of the piston recess 18. In this way, an increase of the quantity of air supplied to the exhaust-remote transfer channel 13 can be achieved also.

In FIGS. 5 through 8 a developed view of the piston skirt 33 in the cylinder bore 39 is illustrated. The piston 5 illustrated in FIGS. 5 to 8 has a piston recess 28 whose ceiling 19 has a bulge 30 for the piston pin boss 29 illustrated in FIG. 5 in dashed lines. The piston pin boss 29 is arranged accordingly in the piston recess 28 so that the piston pin boss 29 does not cover the transfer ports 12 and 14. In the area of the exhaust-remote transfer port 14 a bottom edge 22 of the piston recess 28 is separated by the stay 24 from the bottom side 35 of the piston. The stay 24 has a width b. In the area of the exhaust-near transfer port 12 on the bottom edge 21 of the piston recess 28 a stay 23 having width a is provided. The width a is significantly greater than the width b. The bottom edge 21 is displaced relative to the bottom edge 22 by a displacement f in the direction toward the topside 34 of the piston 5. This causes the exhaust-near transfer port 12 to be closed by the bottom edge 21 while the exhaust-remote transfer port 14 is still completely open toward the piston recess 28. The width a ensures that the transfer port 12 is closed by the piston skirt 33 and does not open into the crankcase 4.

Figure 5:
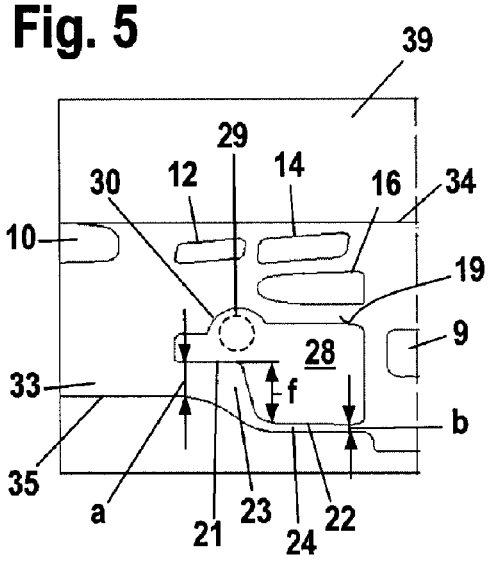
FIG. 5 is a developed view of one half of the cylinder bore and the piston arranged therein in a first piston position.
Figure 6:
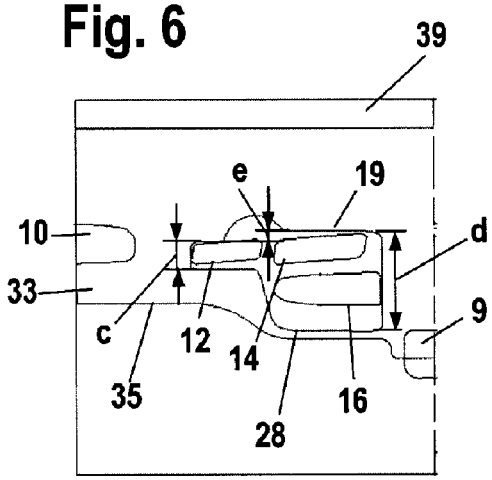
FIG. 6 is a developed view of one half of the cylinder bore and the piston arranged therein in a second piston position.

In FIG. 5, the piston 5 is illustrated in the area of the bottom dead center. The piston recess 28 is arranged below the air channel port 16 and below the transfer ports 12 and 14. In the position illustrated in FIG. 6, the piston 5 is shown before reaching its top dead center. The transfer ports 12 and 14 and the air channel port 16 are located in the area of the piston recess 28 so that air from the air channel port 16 can flow in through the piston recess 28 into the transfer ports 12 and 14. As shown in FIG. 6, in the area of the exhaust-near transfer port 12 the ceiling 19 is displaced in the direction toward the bottom side of the piston by a displacement e. This causes the exhaust-near transfer port 12 to be open completely later than the exhaust-remote transfer port 14. Upon downward stroke of the piston 5, the exhaust-near transfer port 12 is closed before the exhaust-remote transfer port 14 is closed. The height c of the piston recess 28 in the area of the exhaust-near transfer port 12 is only minimally greater than the height of the transfer port 12 measured in the direction of the longitudinal axis 17 of the cylinder. In this way, the exhaust-near transfer port 12 is open completely only for a short period of time. The height d of the piston recess 28 in the area of the exhaust-remote transfer port 14 is significantly greater than the height c.

Figure 7:
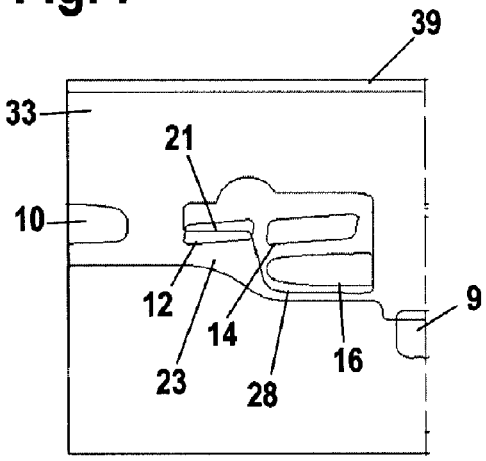
FIG. 7 is a developed view of one half of the cylinder bore and the piston arranged therein in a third piston position.

As illustrated in FIG. 7, upon further upward movement of the piston 5 the exhaust-near transfer port 12 is covered by the bottom edge 21 so that the transfer port 12 is partially closed by the piston skirt 33.

Figure 8:
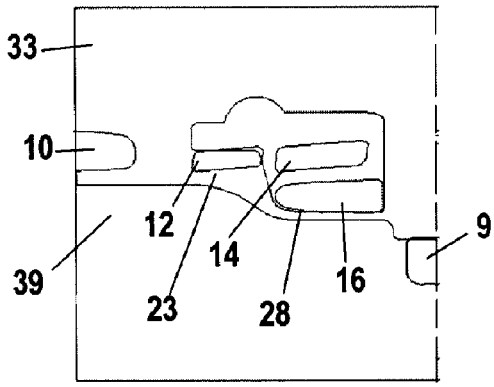
FIG. 8 is a developed view of one half of the cylinder bore and the piston arranged therein in a fourth piston position.

As shown in FIG. 8, in the area of the top dead center of the piston 5 the exhaust-near transfer port 12 is almost completely closed by the piston skirt 33. The exhaust-near transfer port 12 is arranged in the area of the stay 23 and is covered by it.

Figure 9:
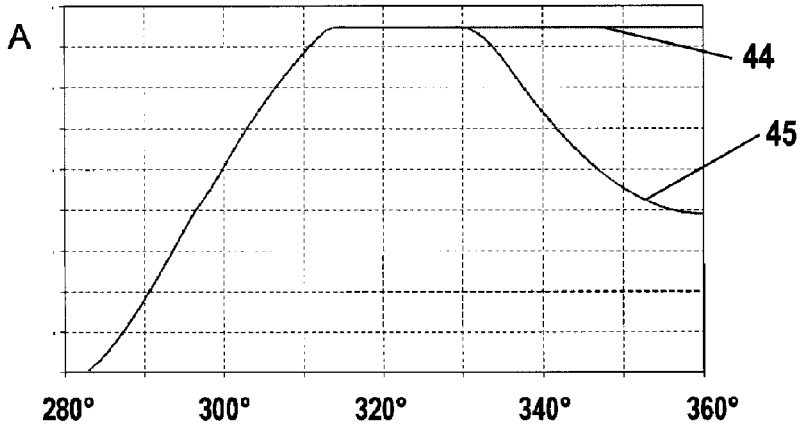
FIG. 9 shows a diagram illustrating the surface area of the transfer ports as a function of the crank angle.

In FIG. 9 the surface area A of the transfer port 12 of the exhaust-near transfer channel 11 that is open toward the piston recess 28 is illustrated as a function of the crank angle. Upon upward movement of the piston 5 the transfer port 12 is opened increasingly until it is completely open at a crank angle of approximately 315 degrees. This situation is illustrated in FIG. 6. Upon further upward movement, the transfer port 12 begins to close again starting at a crank angle of approximately 330 degrees as illustrated by the line 45 in FIG. 9. The closing of the transfer port 12 corresponds to the illustrations of FIGS. 7 and 8. The reduction of the flow cross-section of the exhaust-near transfer channel 11 into the piston recess 28 is affected by the bottom edge 21 of the piston recess 28 that is displaced in the direction toward the piston topside 34. In FIG. 9, the line 44 indicates the course of the flow cross-section without the displaced bottom edge 21, i.e., for a transfer port that is completely open at the bottom dead center of the piston.

Figure 10:
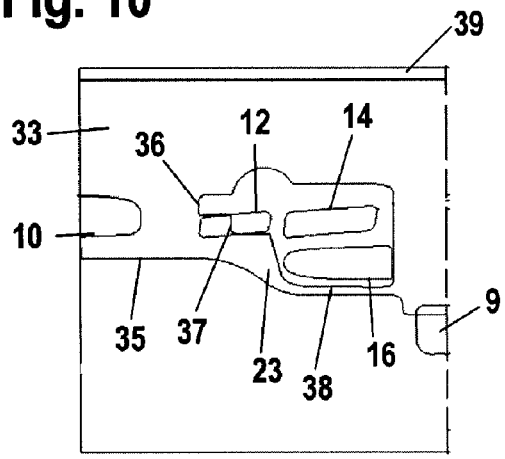
FIG. 10 is a developed view of a cylinder bore and piston of another embodiment.

One embodiment is illustrated in FIG. 10 as a developed view of a piston skirt 33. A piston recess 30 is arranged In the piston skirt 33. The exhaust-near upright edge 36 of the piston recess 38 has at the side facing the bottom side 35 of the piston a section 37 that is displaced relative to the upright edge 36 in the direction toward the interior of the piston recess 38. The exhaust-near transfer port 12 is closed in the area of the section 37 by the piston skirt 33 when the piston 5 is in the area of the top dead center. In this way, the flow cross-section into the exhaust-near transfer channel 11 is reduced.

Figure 11:
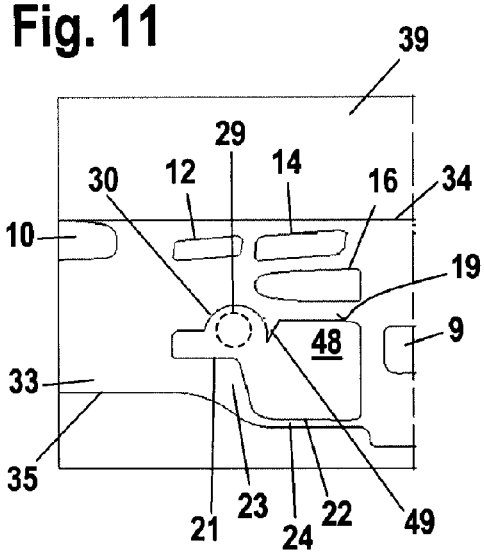
FIG. 11 is a developed view of a cylinder bore and piston of yet another embodiment.

In the embodiment illustrated in FIG. 11, the piston recess 48 has a ramp 49 that extends from the ceiling 19 of the piston recess 48 into the interior of the piston recess 48. The ramp 49 is positioned adjacent to the bulge 30 in the area of the piston pin boss 29. Accordingly, the ramp 49 extends within an area of the circumference of the piston 5 that, when the piston 5 is in the area of the top dead center, is arranged on a side of the transfer port 14 facing the transfer port 12. The ramp 49 effects a deflection of the flow in the piston recess 48 into the transfer port 12 and thus causes a reduction of the amount of air supplied to the transfer port 12 and to the exhaust-near transfer channel 11. It can be advantageous to arrange a ramp, in addition or instead of the ramp 49, at the rear wall of the piston recess 48 or in the area of the bottom edge 22 of the piston recess 48.

Figure 12:
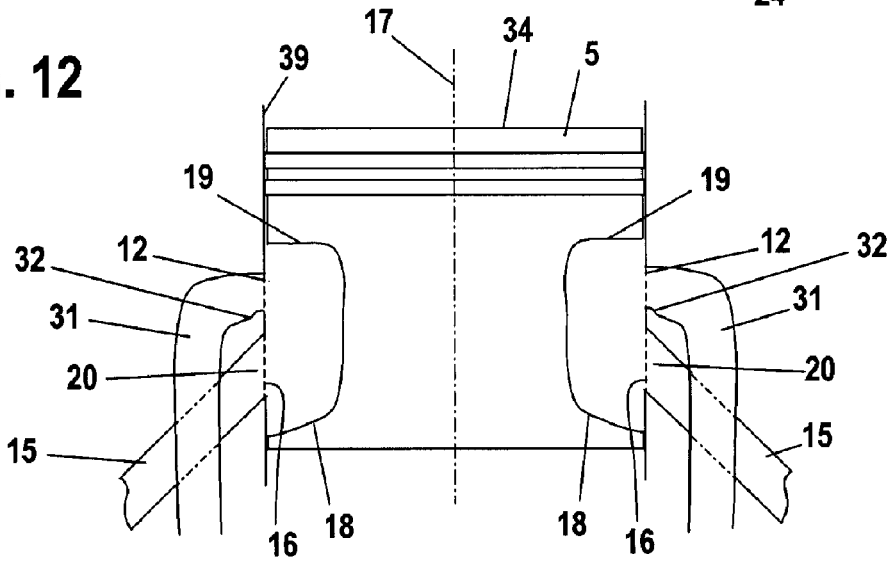
FIG. 12 is a schematic perspective illustration of air channel, piston recess, and transfer channels of yet another embodiment.

The schematic illustration in FIG. 12 shows the arrangement of an exhaust-near transfer channel 31 at the piston recess 18. The exhaust-near transfer channel 31 has a step 32 upstream of its transfer port 12. The step 32 is arranged at the wall of the transfer channel 31 facing the crankcase 4 and causes a reduction of the flow cross-section of the transfer port 12. In this way, the step 32 provides a throttle of the transfer channel 31. By throttling the transfer channel 31 the amount of air supplied to the transfer channel 31 is reduced and the amount of air that is supplied to the exhaust-remote transfer channel 31 is increased. In addition, the air channel 15 is designed such that the air flowing into the piston recess 18 flows substantially against the ceiling 19 of the piston recess 18. However, when throttling the exhaust-near transfer channel 31, the air channel 15 can also open approximately horizontally into the piston recess 18.

Figure 13:
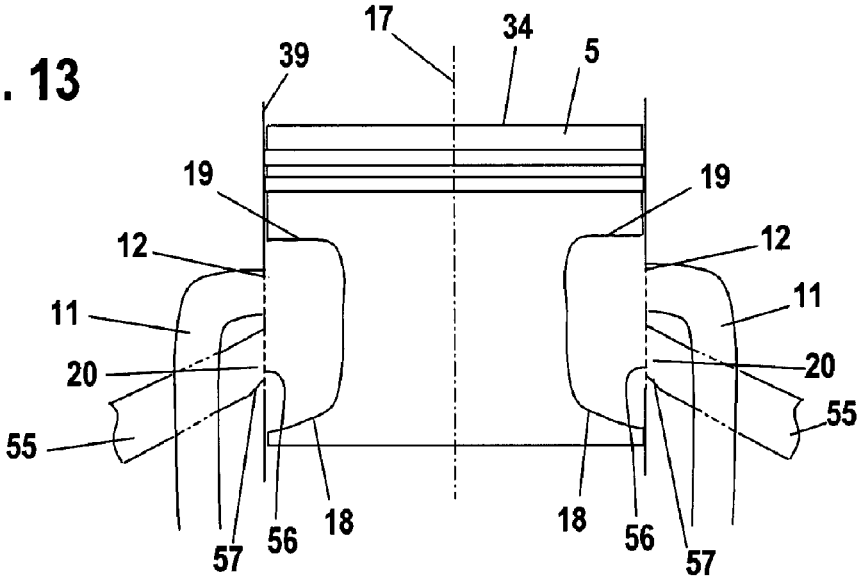
FIG. 13 is a schematic perspective illustration of air channel, piston recess, and transfer channels of yet another embodiment.

The embodiment illustrated in FIG. 13 shows an air channel 55 that is provided upstream of its air channel port 56 with a ramp 57. The ramp 57 is arranged at the side of the air channel 55 facing the crankcase 4 and causes a change of the flow direction of the air flowing into the piston recess 18 in the direction toward the ceiling 19 of the piston recess 18. In this way, the air channel 55 can open into the cylinder bore 39 at a large angle relative to the longitudinal axis 17 of the cylinder. The air channel 55 can open at an angle of approximately 90 degrees into the cylinder bore 39. By means of the ramp 57 the flow into the piston recess 18 can be deflected such that a uniform distribution of the air into the transfer channels 11 and 13 results. The ramp 57 can also be arranged at the walls of the air channel 55 extending in the circumferential direction of the cylinder bore 39 or at the wall of the air channel 55 that is facing the combustion chamber 3. The distribution of the air into the transfer channels 11 and 13 can be affected by the flow direction in the air channel 55 in the area of the air channel port 56 in such a way that a uniform distribution of the air into the transfer channels results.

Figure 14:
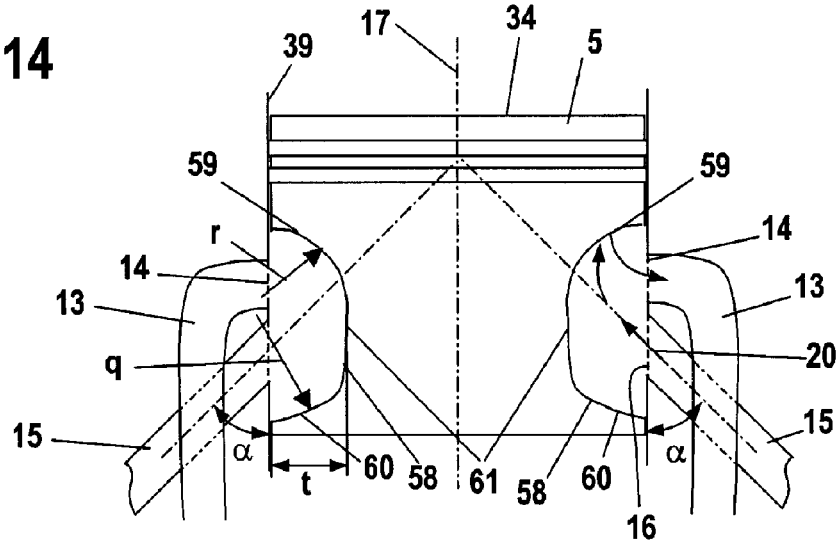
FIG. 14 is a schematic perspective illustration of air channel, piston recess, and transfer channels of yet another embodiment.
Figure 15:
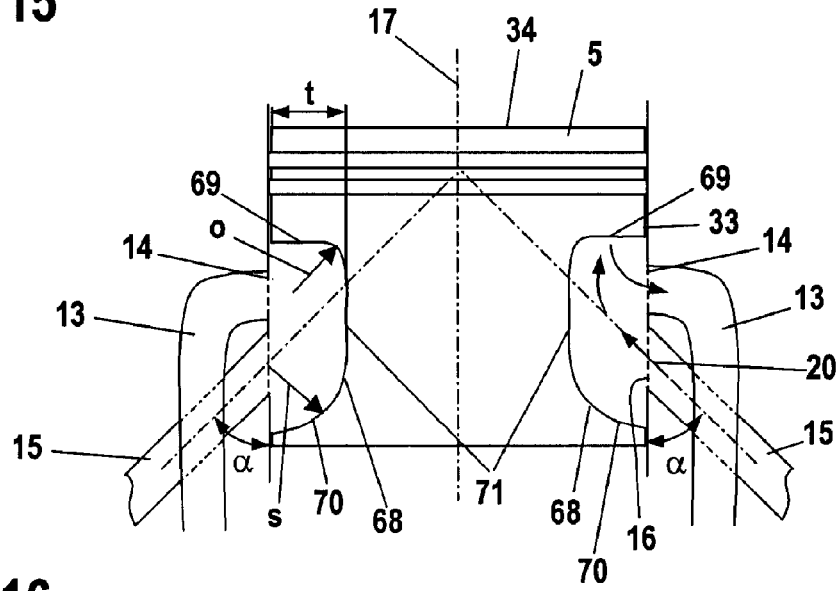
FIG. 15 is a schematic perspective illustration of air channel, piston recess, and transfer channels of yet another embodiment.
Figure 16:
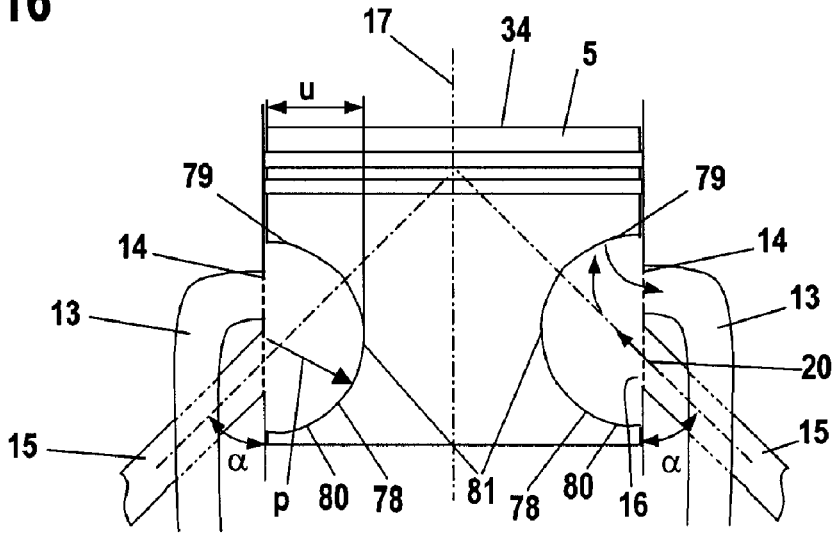
FIG. 16 is a schematic perspective illustration of air channel, piston recess, and transfer channels of yet another embodiment.

In FIGS. 14 to 16 additional embodiments for the configuration of the piston recesses of a piston are illustrated. The pistons 5 illustrated in FIGS. 14 through 16 each have piston recesses that are arranged and configured symmetrically relative to the center plane 46 illustrated in FIG. 2. For improved illustration, the radii of the piston recesses are shown in only one of the piston recesses, respectively.

The piston 5 illustrated in FIG. 14 has two piston recesses 58. The piston recesses 58 have a depth t that is measured in radial direction relative to the longitudinal axis 17 of the cylinder. The depth t indicates the radial spacing of the rear wall 61 of the piston recesses from the piston skirt 33. The depth t indicates in this connection the maximum depth of the piston recesses 58. The ceiling 59 of the piston recesses 58 passes at a radius r into the rear wall 61. The radius r corresponds approximately to the depth t of the piston recess 58. The bottom 60 of the piston recess 58, starting at the piston skirt, also extends at a radius q. The radius q is greater than the depth t of the piston recess 58.

In the embodiment of FIG. 15 a piston 5 with piston recesses 68 is illustrated. The ceiling 69 of the piston recesses 68 passes at a radius o into the rear wall 71 of the piston recesses 68. The radius o is smaller than the depth t of the piston recess 68. The ceiling 69 of the piston recesses 68, starting at the piston skirt 33, initially extends approximately perpendicularly to the longitudinal axis 17 of the cylinder and then passes at a radius o into the rear wall 71. The bottom 70 extends at a radius s that corresponds approximately to the depth t of the piston recess 68. The radius s extends from the piston skirt 33 to the rear wall 71.

In FIG. 16, a piston 5 with piston recesses 78 is illustrated. The ceiling 79, the rear wall 81, and the bottom 80 extend at a continuous radius p. The radius p corresponds to the depth u of the piston recess 78. The piston recess 78 is accordingly curved at a continuous radius.

It can be expedient that the bottom of the piston recess passes at a smaller radius into the rear wall than the ceiling of the piston recess. Advantageously, the bottom and/or the ceiling of the piston recess pass at a radius o, p, q, r, s into the rear wall 61, 71, 81 that is between 50% and 150% of the depth t, u of the piston recess 58, 68, 78. By a suitable selection of the radii, the distribution of air into the transfer channels can be affected such that an approximately identical distribution results. The pistons 5 illustrated in FIGS. 14 to 16 corresponds essentially in other respects to the piston 5 illustrated in FIG. 3.

It is possible to employ other means for affecting the distribution of air into the transfer channels. The means can be provided in the air channel, in the piston recess, and in the transfer channels. It can also be expedient that only individual means for distributing the air are provided. Instead of the ramp in the air channel or a step in the transfer channel, other means for distributing the air can be advantageous. Also, by means of the flow direction into the transfer channels, the distribution of the air into the transfer channels can be affected. The distribution of air into the transfer channels can also be achieved in that the flow resistance in one of the transfer channels, in particular, in the exhaust-remote transfer channel, is reduced. In particular, the means for distributing the air are provided in the cylinder.

While specific embodiments of the invention have been shown and described in detail to illustrate the inventive principles, it will be understood that the invention may be embodied otherwise without departing from such principles.

What is claimed is:

1. A two-stroke engine comprising:

a cylinder having a cylinder bore;

a piston reciprocatingly arranged in the cylinder bore and delimiting together with the cylinder bore a combustion chamber, wherein the piston has at least one piston recess;

a crankcase connected to the cylinder;

a crankshaft rotatably arranged in the crankcase;

a connecting rod connected to the piston and to the crankshaft, wherein the piston drives the crankshaft via the connecting rod;

at least two transfer channels connecting the crankcase to the combustion chamber in pre-defined piston positions of the piston;

the at least two transfer channels each having a transfer port opening into the combustion chamber;

a device supplying fuel;

an air channel supplying combustion air, wherein in predetermined piston positions of the piston, the air channel is connected by the at least one piston recess to the transfer ports of the at least two transfer channels;

an exhaust exhausting exhaust gases generated in the combustion chamber;

wherein the air channel, the at least one piston recess, and the at least two transfer channels communicating with the at least one piston recess define an air passage;

wherein the air passage is configured to provide an approximately uniform distribution of air from the air channel into the at least two transfer channels communicating with the at least one piston recess, wherein the air channel opens into the cylinder bore such that a flow direction of the airflowing from the air channel into the at least one piston recess is directed against a ceiling of the at least one piston recess, wherein the flow direction of the air flowing into the at least one piston recess against the ceiling of the at least one piston recess is oriented at an angle of less than 90 degrees relative to a longitudinal axis of the cylinder.

2. The two-stroke engine according to claim 1, wherein in at least one position of the piston a first one of the transfer ports arranged proximal to the exhaust is at least partially closed relative to the at least one piston recess while a second one of the transfer ports arranged distal to the exhaust is completely open relative to the at least one piston recess, wherein one of the at least one position of the piston is the top dead center of the piston.

3. The two-stroke engine according to claim 2, wherein the piston has a piston skirt closing off a section of the first transfer port which section extends in a circumferential direction of the piston, wherein the at least one piston recess has an upright edge arranged proximal to the exhaust wherein the upright edge has at least one section that is displaced toward an interior of the piston recess relative to the first transfer port.

4. The two-stroke engine according to claim 2, wherein the piston has a piston skirt closing off a section of the first transfer port which section extends in longitudinal direction of the cylinder, wherein the at least one piston recess has a bottom edge and at least one section of the bottom edge in the area of the first transfer port is displaced in a direction toward a top side of the piston relative to a section of the bottom edge in the area of the second transfer port, wherein a stay formed between the bottom edge of the at least one piston recess and a bottom side of the piston is wider in the area of the first transfer port than in the area of the second transfer port, and wherein the at least one piston recess has a ceiling and a portion of the ceiling in the area of the first transfer port is displaced toward the crankcase relative to a portion of the ceiling in the area of the second transfer port.

5. The two-stroke engine according to claim 1, wherein the distribution of air entering the at least one piston recess into the at least two transfer channels communicating with the at least one piston recess has a ratio of 60% to 40% and 40% to 60%, respectively.

6. The two-stroke engine according to claim 1, wherein the angle is between 30 degrees and 60 degrees.

7. The two-stroke engine according to claim 1, wherein the at least one piston recess has means that distribute the air into the at least two transfer channels.

8. The two-stroke engine according to claim 1, wherein the connecting rod is secured on the piston by a piston pin, wherein the piston pin is arranged approximately at a level of a ceiling of the at least one piston recess and projects at a piston pin boss from an exterior of the piston, wherein the piston pin boss is arranged in the at least one piston recess.

9. The two-stroke engine according to claim 1, wherein the connecting rod is secured on the piston by a piston pin, wherein the piston pin is arranged approximately at a level of a ceiling of the at least one piston recess and projects at a piston pin boss from an exterior of the piston, wherein the piston pin boss is separated by a stay from the at least one piston recess and wherein the stay, in at least one piston position, closes off at least partially one of the transfer ports that is proximal to the exhaust.

10. The two-stroke engine according to claim 1, wherein the at least one piston recess has a ramp for deflecting a flow of air in the at least one piston recess into one of the transfer ports that is distal to the exhaust.

11. The two-stroke engine according to claim 1, further comprising a mixture channel opening into the cylinder bore for supplying a fuel/air mixture to the crankcase, wherein at least a portion of the length of the air channel extends on a side of the mixture channel facing the crankcase, wherein the air channel has an air channel port opening into the cylinder bore, and wherein the air channel port is arranged on a side of one of the transfer ports that is distal to the exhaust, which side is facing the crank case.

12. The two-stroke engine according to claim 1, wherein the air channel opens into the cylinder bore on a side of the cylinder opposite the exhaust.

13. A two-stroke engine comprising:

a cylinder having a cylinder bore;

a piston reciprocatingly arranged in the cylinder bore and delimiting together with the cylinder bore a combustion chamber, wherein the piston has at least one piston recess;

a crankcase connected to the cylinder;

a crankshaft rotatably arranged in the crankcase;

a connecting rod connected to the piston and to the crankshaft, wherein the piston drives the crankshaft via the connecting rod;

at least two transfer channels connecting the crankcase to the combustion chamber in pre-defined piston positions of the piston;

the at least two transfer channels each having a transfer port opening into the combustion chamber;

a device supplying fuel;

an air channel supplying combustion air, wherein in predetermined piston positions of the piston, the air channel is connected by the at least one piston recess to the transfer ports of the at least two transfer channels;

an exhaust exhausting exhaust gases generated in the combustion chamber;

wherein the air channel, the at least one piston recess, and the at least two transfer channels communicating with the at least one piston recess define an airpassage;

wherein the air passage is configured to provide an approximately uniform distribution of air from the air channel into the at least two transfer channels communicating with the at least one piston recess;

wherein in at least one position of the piston a first one of the transfer ports of the at least two transfer channels is partially closed and a second one of the transfer ports is completely open;

wherein the first transfer port has a section that extends in a circumferential direction of the piston and is closed off by a skirt of the piston.

14. The two-stroke engine according to claim 13, wherein at least a section of an upright edge of the at least one piston recess is displaced toward an interior of the at least one piston recess relative to one of the transfer ports.

* * * * *